US009904244B2

(12) United States Patent
Ge et al.

(10) Patent No.: US 9,904,244 B2
(45) Date of Patent: Feb. 27, 2018

(54) IMAGE FORMING APPARATUS FOR STABILIZING A DEVELOPING PROPERTY OF A DEVELOPER IN A DEVELOPING DEVICE WITH RESPECT TO A CURRENT ENVIRONMENTAL STATE

(71) Applicant: FUJI XEROX CO., LTD., Tokyo (JP)

(72) Inventors: Wenxiang Ge, Ebina (JP); Toru Iwanami, Ebina (JP); Yuki Sekura, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/248,982

(22) Filed: Aug. 26, 2016

(65) Prior Publication Data

US 2017/0248914 A1 Aug. 31, 2017

(30) Foreign Application Priority Data

Feb. 26, 2016 (JP) ..... 2016-035389

(51) Int. Cl.
*G03G 21/20* (2006.01)
*G03G 15/00* (2006.01)

(52) U.S. Cl.
CPC ..... *G03G 21/203* (2013.01); *G03G 15/5058* (2013.01)

(58) Field of Classification Search
CPC ..... G03G 21/203
See application file for complete search history.

(56) References Cited

U.S. PATENT DOCUMENTS

2005/0152708 A1* 7/2005 Narimatsu ..... G03G 15/5041 399/30
2006/0029405 A1* 2/2006 Tanaka ..... G03G 15/553 399/27
2006/0204262 A1* 9/2006 Hayashida ..... G03G 15/065 399/66
2007/0081829 A1* 4/2007 Funayama ..... G03G 15/5041 399/27

FOREIGN PATENT DOCUMENTS

JP 2005-173483 A 6/2005

* cited by examiner

*Primary Examiner* — Clayton E Laballe
*Assistant Examiner* — Victor Verbitsky
(74) *Attorney, Agent, or Firm* — Oliff PLC

(57) ABSTRACT

An image forming apparatus includes a first condition section that derives, from the density of the image detected by an image density detector, a forming condition in forming an image such that the density of the image formed comes close to a predetermined target density, a second condition section that derives, from the environmental state detected by the environmental detector, a forming condition such that the density of the formed image becomes the target density, and a stabilization section that causes, when a difference between the two forming conditions exceeds a predetermined degree, the image forming section to perform a stabilization operation which stabilizes a developing property of the developer in the developing device as compared to the current environmental state, and thereafter causes the formation of an image, the density detection, and the derivation of the forming condition by the first condition section to be performed again.

4 Claims, 8 Drawing Sheets

IMAGE FORMING APPARATUS FOR STABILIZING A DEVELOPING PROPERTY OF A DEVELOPER IN A DEVELOPING DEVICE WITH RESPECT TO A CURRENT ENVIRONMENTAL STATE

CROSS-REFERENCE TO RELATED APPLICATIONS

This application is based on and claims priority under 35 USC 119 from Japanese Patent Application No. 2016-035389 filed Feb. 26, 2016.

BACKGROUND

1. Technical Field

The present invention relates to an image forming apparatus.

2. Related Art

In order to match an output density to a target density in a conventional electro-photographic image forming apparatus, a technology is known in which a patch image is formed to measure the density thereof, and an image forming condition is adjusted so that a difference between the measured density and the target density is reduced. In the electro-photographic image forming apparatus, generally, an image holding member is electrically charged to form an electrostatic latent image by exposure light based on image data, and the latent image is developed with a developer, which includes a toner, so as to create a toner image. Because the relationship (output characteristic) between the toner image density formed in this manner and the image data depends on the image forming condition, such as the intensity of exposure light or a developing bias, it is necessary to adjust, for example, the intensity of exposure light or the developing bias to an appropriate value in reproducing the target density. This adjustment of the image forming condition is hereinafter occasionally referred to as "setup."

When, for example, the environmental temperature or environmental humidity of the image forming apparatus varies, the chargeability of the developer varies, and consequently, the developing property varies. Therefore, it is desirable to acquire an appropriate image forming condition by performing the setup.

SUMMARY

According to an aspect of the invention, there is provided an image forming apparatus including: an image holding member that holds an image formed on a surface thereof; a latent image forming device that forms an electrostatic latent image on the image holding member; a developing device that contains a developer therein and develops the latent image by the developer; an image density detector that detects a density of the image formed as a result of the developing; a first condition section that derives, from the density of the image detected by the image density detector, a forming condition in forming an image by an image forming section including the latent image forming device and the developing device such that the density of the image formed by the image forming section comes close to a predetermined target density; an environmental detector that detects an environmental state of the image forming section; a second condition section that derives, from the environmental state detected by the environmental detector, a forming condition that is previously made to correspond to an environmental state of the image forming section such that the density of the formed image becomes the target density; and a stabilization section that causes, when a difference between respective forming conditions acquired by the first condition section and the second condition section exceeds a predetermined degree, the image forming section to perform a stabilization operation in which a developing property of the developer in the developing device is stabilized with respect to a current environmental state, and thereafter causes the formation of the image by the image forming section, the density detection by the image density detector, and the derivation of the forming condition by the first condition section to be performed again.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the accompanying drawings.

Figure 1:
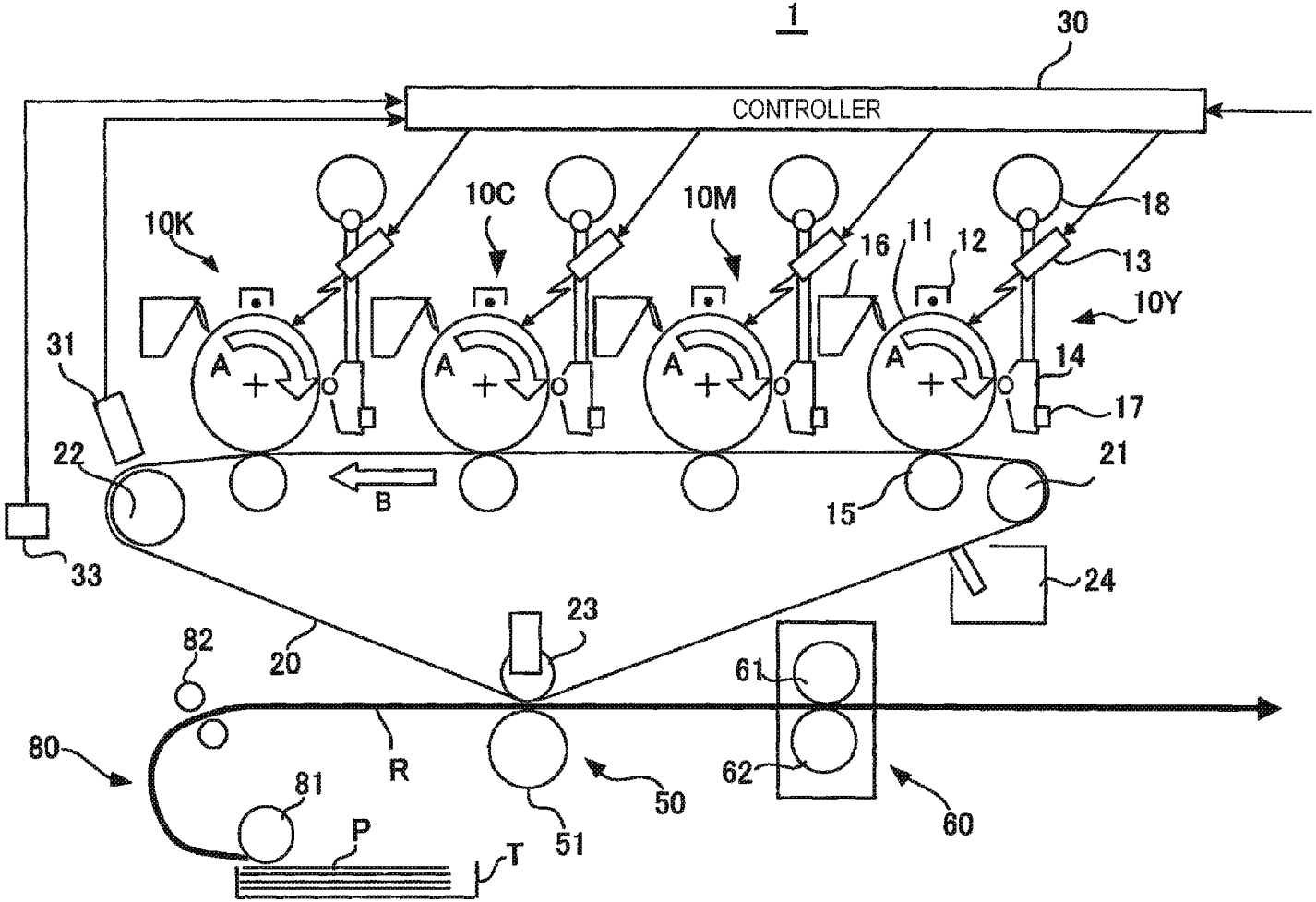
FIG. 1 is a schematic view illustrating a configuration of a printer corresponding to a specific exemplary embodiment of an image forming apparatus.

FIG. 1 is a schematic view illustrating a configuration of a printer corresponding to a specific exemplary embodiment of an image forming apparatus.

The printer 1 is provided with plural (four in the present exemplary embodiment) image forming units 10 (specifically, 10Y (yellow), 10M (magenta), 10C (cyan), and 10K (black)) in which respective color component toner images are formed by a so-called electrophotographic method. In addition, the printer 1 is provided with an intermediate transfer belt 20, to which the respective color component toner images formed by the respective image forming units 10 are sequentially transferred (primarily transferred) and held. In addition, the printer 1 is provided with a secondary transfer device 50, which collectively transfers (secondarily transfers) the toner images, which are transferred to the intermediate transfer belt 20, to paper P. In addition, the printer 1 is provided with a fixing device 60, which fixes the secondarily transferred toner images to the paper P, and a controller 30, which controls the respective devices of the printer 1.

The respective image forming units 10 (10Y, 10M, 10C, and 10K) have the same configuration, except for the color of a toner used therein. Thus, descriptions will be made with reference to the yellow image forming unit 10Y by way of an example. The image forming unit 10 is provided with a photoconductor drum 11, which has a photoconductor layer and is rotated in the direction represented by the arrow A, and a charging device 12, an exposure device 13, a developing device 14, a primary transfer roll 15, and a drum cleaner 16 are arranged around the photoconductor drum 11.

The charging device 12 electrically charges the photoconductor drum 11 with a predetermined potential, and the exposure device 13 exposes the charged photoconductor drum 11 and writes an electrostatic latent image on the surface of the photoconductor drum 11. While a non-contact type corona discharging device is employed as the charging device 12 in the present exemplary embodiment, a contact type charging roll may also be employed. In addition, while a method of scanning the surface of the photoconductor drum 11 with laser light is employed in the exposure device 13 in the present exemplary embodiment, an exposure method using, for example, an LED array in which LED elements are aligned in a line may be employed.

The developing device 14 accommodates a developer, which includes a toner having a color corresponding to the image forming unit 10 (yellow toner in the yellow image forming unit 10Y), and develops an electrostatic latent image on the photoconductor drum 11 using the toner in the developer. A transport member configured to transport the developer while agitating is provided within the developing device 14, and when the developer is agitated by the transport member, the toner in the developer is electrically charged. In addition, the developing device 14 is provided with a toner sensor 17 to sense the toner density in the developing device 14, and the toner is properly supplied from a toner cartridge 18 in such a manner of causing the density sensed by the toner sensor 17 to be constant.

The primary transfer roll 15 primarily transfers the toner image formed on the photoconductor drum 11 to the intermediate transfer belt 20. The drum cleaner 16 removes a residue (e.g., toner) from the photoconductor drum 11 after the primary transfer.

The photoconductor drum 11 corresponds to one example of an image holding member in the present invention, a combination of the charging device 12 and the exposure device 13 corresponds to one example of a latent image forming device in the present invention, the developing device 14 corresponds to one example of a developing device in the present invention, and the toner corresponds to one example of a color material in the present invention. In addition, the image forming unit 10 corresponds to one example of an image forming section in the present invention.

The intermediate transfer belt 20 is an endless belt member supported in a stretched state by a driving roll 21, a stretching roll 22, and a backup roll 23, and is circulated in the direction indicated by the arrow B. In addition, a belt cleaner 24, which removes a residue (e.g., toner) on the intermediate transfer belt 20 after the secondary transfer, is located at the upstream side of the driving roll 21. In addition, an optical image density sensor 31, which measures the toner image density on the intermediate transfer belt 20, is located at a position opposite to the stretching roll 22 with the intermediate transfer belt 20 being interposed therebetween. A measured value acquired via a measurement by the image density sensor 31 is transmitted to the controller 30. The image density sensor 31 corresponds to one example of an image density detector in the present invention.

A secondary transfer roll 51 is located at a position opposite to the backup roll 23 with the intermediate transfer belt 20 being interposed therebetween, and the backup roll 23 and the secondary transfer roll 51 function as a secondary transfer device 50.

The printer 1 of the present exemplary embodiment is provided with a paper transport system 80, which transports paper P as a recording medium, along a transport path R, and a paper tray T, a pickup roll 81, and a transport roll 82 are arranged in the paper transport system 80.

In the present exemplary embodiment, papers P as recording mediums are accommodated to be stacked in the paper tray T. In some cases, OHP sheets, plastic papers, envelopes, or the like may be accommodated as recording mediums, apart from the papers. Even in the case where such recording mediums are accommodated, the basic operation of the printer 1 is the same.

The pickup roll 81 extracts a paper P from the paper tray T, and the transport roll 82 transports the extracted paper P along the transport path R.

The fixing device 60 having a heating roll 61 and a pressure roll 52 is located on the transport path R, and fixes an image on the paper P passing therethrough to the paper P using heat and pressure.

After fixing, the paper P is delivered along the transport path R to a loading tray (not illustrated) outside the apparatus.

The printer 1 of the present exemplary embodiment is provided with an environmental sensor 33 to measure the environmental temperature and environmental humidity inside the printer 1, and a measured value acquired via a measurement by the environmental sensor 33 is also transmitted to the controller 30. The value measured by the environmental sensor 33 is appropriately transmitted to the controller 30 while the printer 1 is operating, and when the power source of the printer 1 is turned off, the last measured value is saved in the controller 30. The environmental sensor 33 corresponds to one example of an environmental detector in the present invention.

Next, the basic imaging process of the printer 1 will be described.

When image data is transmitted from an external device, such as a personal computer (PC), to the printer 1, the image data is received by the controller 30, and the controller 30 performs a gradation correction processing, a screen processing, or the like on the image data of four colors (yellow (Y), magenta (M), cyan (C), and black (K)), so as to produce image signals of the respective colors. Then, the image signal of a corresponding color is input from the controller 30 to the exposure device 13 of each image forming unit (specifically, 10Y, 10M, 10C, or 10K) so that an electrostatic latent image is formed on each photoconductor drum 11. Then, toner images of the respective colors are formed on the photoconductor drums 11 by developing, and are primarily transferred to the surface of the intermediate transfer belt 20 in sequence by the primary transfer rolls 15 so that a color toner image is formed.

The color toner image on the intermediate transfer belt 20 is transported to a secondary transfer position according to the rotation of the intermediate transfer belt 20, and is superposed with a paper P transported by the paper transport system 80. The toner image superposed with the paper P is transferred to the paper P by the action of a transfer magnetic field in the secondary transfer device 50.

The paper P having the toner image transferred thereon is transported to the fixing device 60, and the toner image is fixed to the paper P by the fixing device 60. Thereafter, the paper P is sent to the outside of the apparatus.

In addition to a so-called job operation for forming an image represented by the image data transmitted from an external device, the printer 1 illustrated in FIG. 1 also performs a so-called setup operation for adjusting an output density of an image in the printer 1 to a target density. With this setup, a patch image for density adjustment is formed, the output density in a current state is checked by measuring the density of the patch image using the image density sensor 31 described above, and required calculation and adjustment are performed in relation to an image forming condition in the image forming unit 10. Here, the "forming condition" refers to a condition, which has an effect on the density of an image formed by the image forming unit 10, which is an image forming section, and is set with respect to the image forming section. The forming condition adjusted by the setup includes, for example, a charging potential in the charging device 12, the intensity of exposure light in the exposure device 13, the density of the toner in the developing device 14, a developing bias in the developing device 14, or a developing potential, which is a difference between an exposure potential of the photoconductor drum 11 and the developing bias. Because a conventional known calculation method may be arbitrarily employed as a specific method of calculating the forming condition based on the patch image, a detailed description thereof will be omitted.

Generally, the execution timing of the setup is, for example, immediately after the power source of the printer 1 is started, or before the job is initiated. However, in a case where the timing is immediately after the power source of the printer 1 is started, when a substantial environmental variation has occurred while the power source was turned off, the developing property of the developer in the developing device may not be stabilized with respect to an environment because the developing property may not following the environmental variation. In addition, when the setup is performed in a state in which the developing property is not stabilized, the target density may be acquired immediately after the setup. However, the output density subsequently deviates from the target density as the developing property is stabilized with respect to an environment. Therefore, in the printer 1 of the present exemplary embodiment, a setup processing is contrived in which the setup is performed immediately after the startup of the power source.

Hereinafter, the setup processing performed immediately after the startup of the power source will be described in detail. The setup processing is executed by the controller 30 described above.

Figure 2:
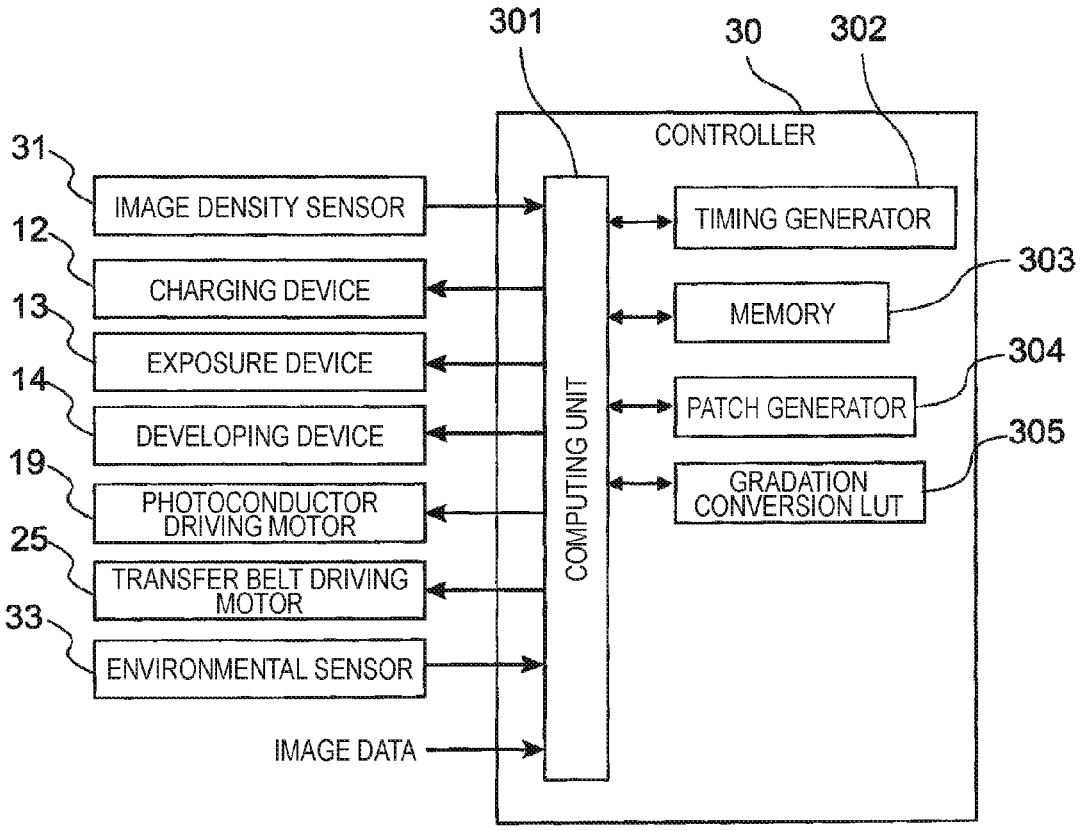
FIG. 2 is a functional block diagram illustrating a functional structure of a controller.

FIG. 2 is a functional block diagram illustrating a functional structure of the controller 30.

The controller 30 is connected to each element inside the printer 1 illustrated in FIG. 1, and performs, for example, the acquisition of a measured value or the control of an operation. Specifically, the controller 30 acquires a measured density value from the image density sensor 31, and sets a charging potential to the charging device 12. In addition, the controller 30 sets the intensity of exposure light to the exposure device 13 and inputs an image signal to the exposure device 13. The controller 30 sets a developing bias or an inner toner density to the developing device 14. In addition, the controller 30 controls the driving speed or the driving timing of a photoconductor driving motor 19 configured to drive the photoconductor drums 11, or a transfer belt driving motor 25 configured to drive the driving roll 21. In addition, the controller 30 acquires a measured value using the environmental sensor 33, and obtains image data from an external device.

As an internal structure, the controller 30 includes a computing unit 301, a timing generator 302, a memory 303, a patch generator 304, and a gradation conversion LUT 305.

The computing unit 301 realizes various control processings by executing a program stored in the memory 303. The timing generator 302 generates a timing signal, which is a reference for the timing of an operation of each element inside the printer 1. The memory 303 is a nonvolatile or recordable memory, and stores a program to be executed by the computing unit 301, or data to be used, for example, when the program is executed. It is assumed that data representing the above-described target density is stored in the memory 303 in advance. In addition, the measured value of the environmental sensor 33 is stored in the memory 303. The patch generator 304 generates image data that represents various patch images used for setup, gradation correction, or the like. The gradation conversion LUT 305 defines the conversion of image data for adjusting an output gradation from the printer 1 to a desired gradation, and the computing unit 301 performs a gradation conversion on image data transmitted from the outside, based on the conversion defined in the gradation conversion LUT 305.

Hereinafter, the setup processing will be described with reference to FIG. 2 and the flowchart.

Figure 3:
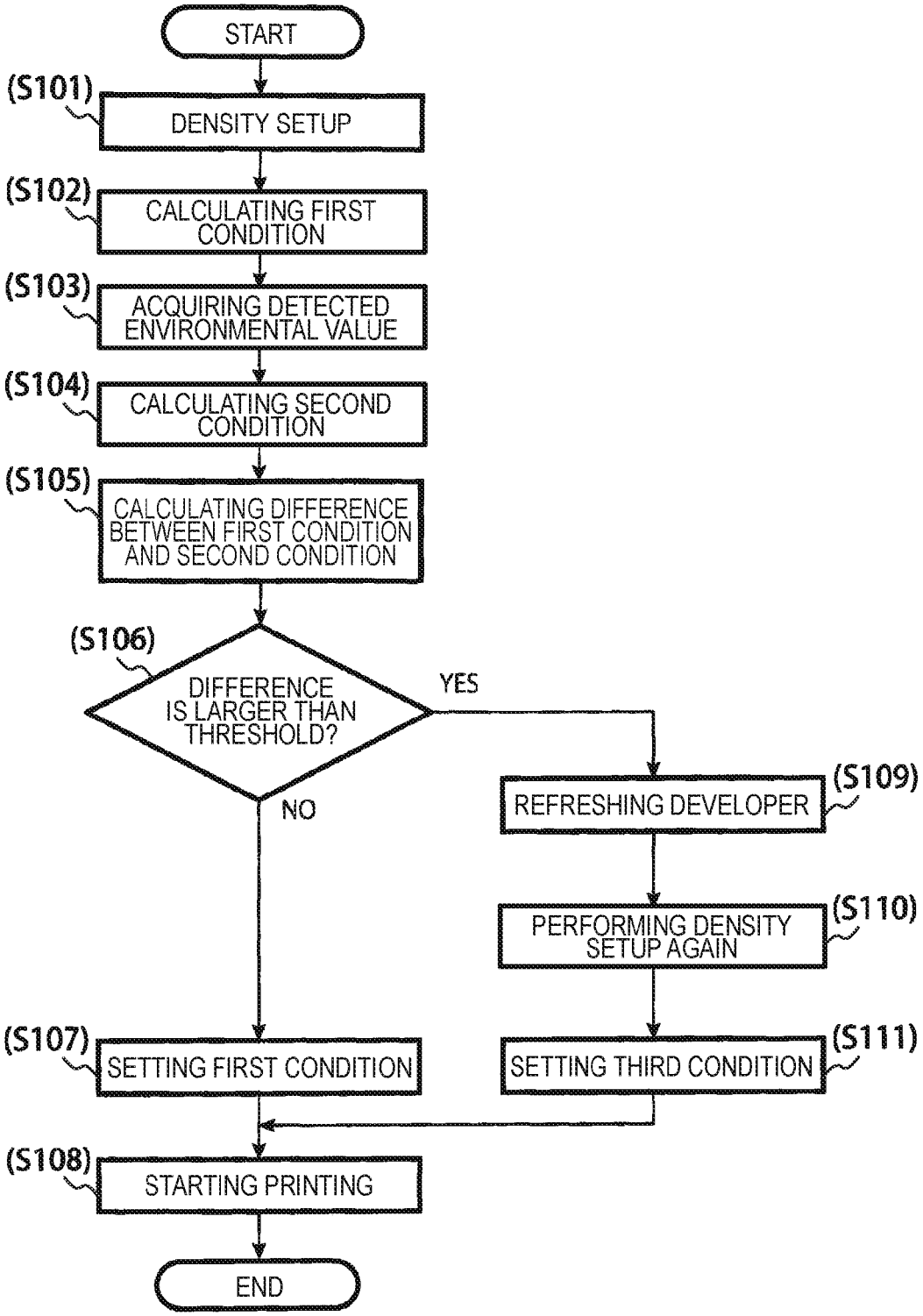
FIG. 3 is a flowchart illustrating a setup processing performed immediately after the startup of a power source.

FIG. 3 is a flowchart illustrating the setup processing performed immediately after the startup of the power source.

When the setup processing illustrated in the flowchart of FIG. 3 is initiated, typical setup is initiated first (step S101). That is, the computing unit 301 operates the charging device 12, the developing device 14, the photoconductor driving motor 19, and the transfer belt driving motor 25 so that the patch generator 304 generates image data of a patch image, and then, the computing unit 301 inputs the image data to the exposure device 13 so as to form the patch image. The density of the patch image is measured by the image density sensor 31, and the measured value is read by the computing unit 301. Thereafter, the computing unit 301 calculates a forming condition (first condition) for realizing a target density, based on a difference between the measured density value and the target density (step S102). As described above, although the forming condition includes the charging potential, the intensity of exposure light, or the like, a detailed description of the calculation thereof will be omitted. The operation of step S102 corresponds to an operation a one example of a first condition section in the present invention.

Next, a value measured (detected) by the environmental sensor 33 is read by the computing unit 301 (step S103), and a forming condition (second condition) for realizing the target density is calculated by the computing unit 301 based on measured values of temperature and humidity (step S104). This calculation is performed by introducing the measured values of temperature and humidity into a relational expression, which empirically or theoretically represents the relationship between the temperature/humidity and the forming condition. It is assumed that this relational expression is also stored in the memory 303 in advance. The operation of step S104 corresponds to an operation as one example of a second condition section in the present invention.

A difference between the first condition and the second condition, which are calculated in step S102 and step S104, is calculated by the computing unit 301 (step S105), and is compared with a threshold, which is stored in the memory 303 in advance (step S106). The threshold is a reference value for determining whether a difference between the empirically or theoretically estimated value of the forming condition and the forming condition acquired from the density of the actual patch image is large.

In a case where the difference between the first condition and the second condition is less than the threshold, it is thought that the developing property of the developer is sufficiently stabilized with respect to an environment (step S106; NO). Therefore, the first condition calculated in step S102 is used for setting, and is set to, for example, the charging device 12 or the developing device 14 by the computing unit 301 (step S107).

Thereafter, printing is initiated under the setting (step S108), and the setup processing is terminated.

Meanwhile, in a case where the difference between the first condition and the second condition is larger than the threshold (step S106; YES), it is thought that the developing property of the developer is not yet stabilized with respect to an environment, and thus, a developer refresh mode to be described below is performed (step S109). As the state in which the developing property is not stabilized as described above, for example, a state is considered in which the environmental humidity greatly varies while the power source is turned off, but the humidity of the developer in the developing device 14 does not vary particularly.

The developing property of the developer is rapidly stabilized with respect to an environment by the developer refresh mode. Thus, thereafter, the setup is performed as in step S101 (step S110). Then, a forming condition (third condition) is calculated as in step S102, and the calculated forming condition is directly used for setting such that the forming condition is set to the charging device 12, the developing device 14, or the like by the computing unit 301 (step S111). Thereafter, printing is initiated under the setting (step S108), and the setup processing is terminated.

The operations of steps S109 to S111 corresponds to an operation that is one example of a stabilization section in the present invention.

As the developer refresh mode is performed as needed, an appropriate forming condition is set even if an environmental variation is great.

Here, the contents of the developer refresh mode will be described.

Figure 4:
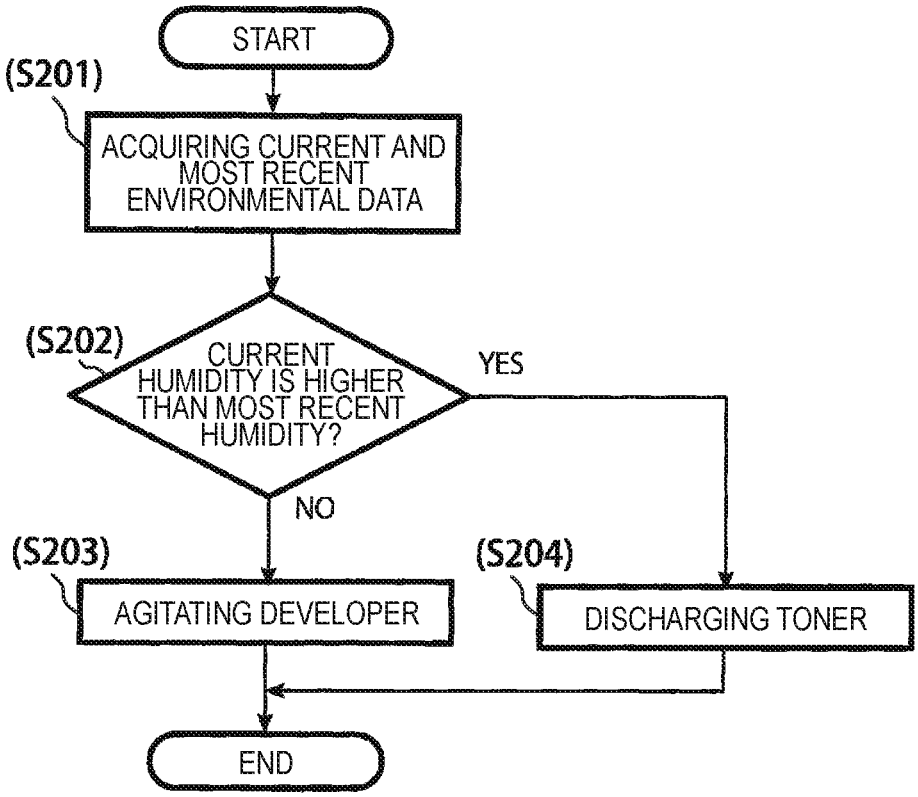
FIG. 4 is a flowchart illustrating an execution procedure of a developer refresh mode.

FIG. 4 is a flowchart illustrating an execution procedure of the developer refresh mode.

The developer refresh mode illustrated in the flowchart of FIG. 4 serves to stabilize the developing property of the developer with respect to an environment, for example.

In the developer refresh mode, first, the computing unit 301 acquires a value (environmental data) most recently measured by the environmental sensor 33 and saved when the power source is turned off, and a value (environmental data) currently measured by the environmental sensor 33 (step S201). Subsequently, these measured values are compared with each other (step S202), and when the current humidity is lower than the most recent humidity (step S202: NO), an agitating operation of the developer is performed by the above-described transport member in the developing device 14 (step S203). With this agitating operation, the humidity of the developer is rapidly reduced to a value suitable for the environmental humidity so that the electrification amount of toner in the developer is increased, and consequently, the developing property of the developer is stabilized to be suitable for the environmental humidity.

Meanwhile, when the current humidity is higher than the most recent humidity (step S202: YES), the toner within the developing device 14 is ejected by, for example, the formation of a patch image having a high image density, and thus, a new toner is supplied to the developing device 14 (step S204). As a result, the electrification amount of toner in the developer is rapidly reduced so that the developing property of the developer is stabilized to be suitable for the environmental humidity.

In this way, when the developer refresh mode is performed, the developing property is rapidly stabilized with respect to the environment.

A result of a control realized by the printer 1 of the present exemplary embodiment, which appropriately performs the developer refresh mode, will be described below with reference to the graphs.

Figure 5:
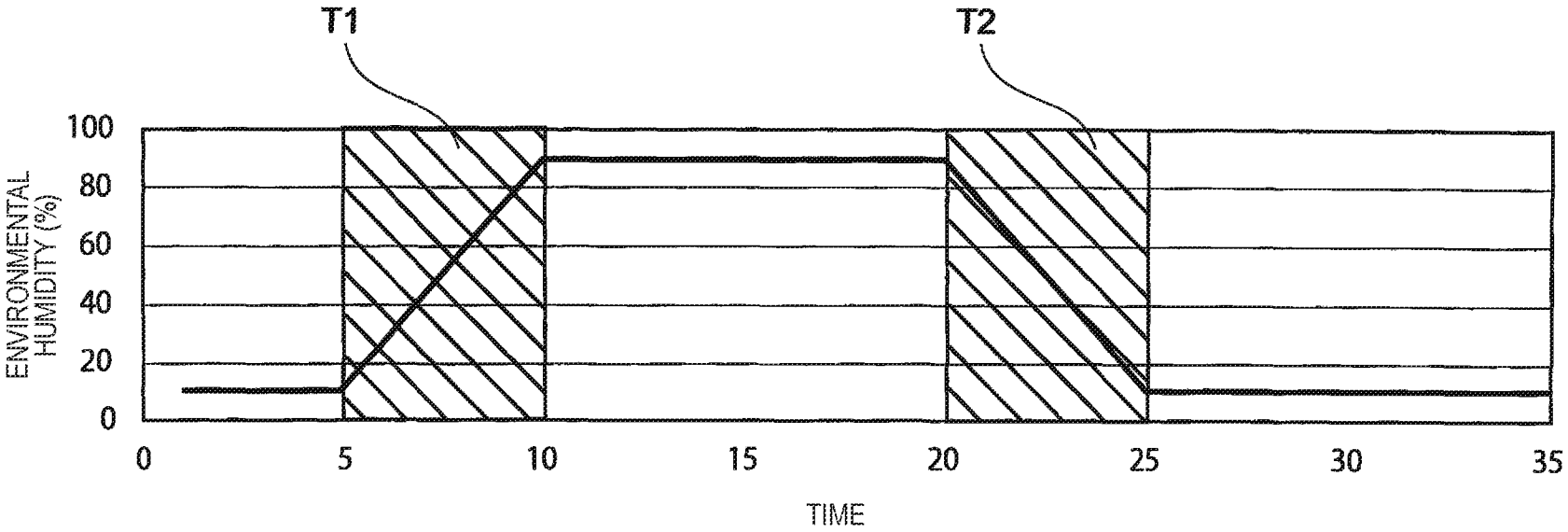
FIG. 5 is a graph illustrating a variation in humidity as an example of environmental variation.

FIG. 5 is a graph illustrating a variation in humidity as an example of an environmental variation.

In the graph of FIG. 5, the horizontal axis represents time, and the vertical axis represents environmental humidity. The graph illustrates an example of a variation in environmental humidity with respect to a time range from time "0" to time "35." It is assumed that the power source of the printer 1 is turned off during a first stopping period T1 from time "5" to time "10" and during a second stopping period T2 from time "20" to time "25."

In the example illustrated in FIG. 5, during the first stopping period T1, the environmental humidity is raised from 10% to 90%, and during the second stopping period T2, the environmental humidity is lowered from 90% to 10%. Thus, a great variation in humidity is caused within a short time.

Figure 6:
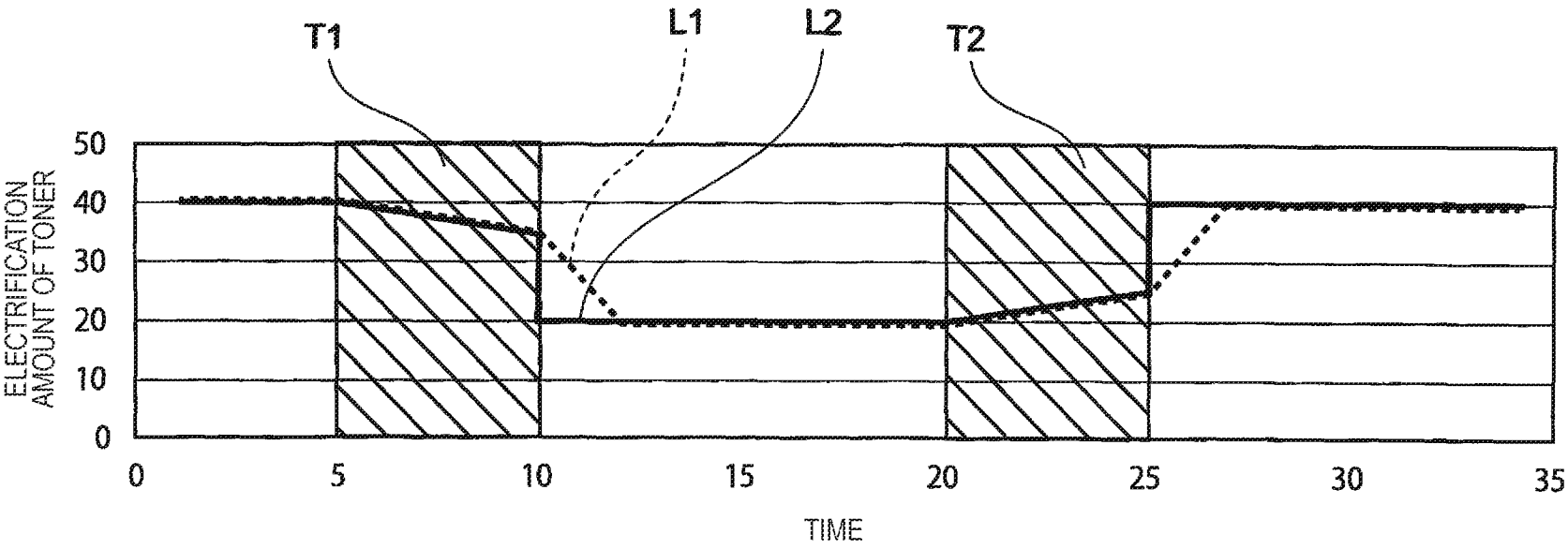
FIG. 6 is a graph illustrating a variation in electrification amount of toner to a variation in environmental humidity illustrated in FIG. 5.

FIG. 6 is a graph illustrating a variation in the electrification amount of toner in relation to a variation in environmental humidity illustrated in FIG. 5. The electrification amount of toner refers to a factor for determining the amount of the toner to be attached to the latent image during the development, and determines the developing property of a developer.

In the graph of FIG. 6, the horizontal axis represents time and the vertical axis represents the electrification amount of toner. In addition, a dotted line L1 in the graph represents a variation in electrification amount of toner when conventional setup is performed, and a solid line L2 in the graph represents a variation in electrification amount of toner in the present exemplary embodiment.

The electrification amount of toner is "40" when the developer is stabilized with respect to an environmental humidity of 10%, and the electrification amount of toner is "20" when the developer is stabilized with respect to an environmental humidity of 90%. However, because the humidity rapidly varies during the first stopping period T1, the electrification amount of toner is reduced to only "35" during the first stopping period T1, and thus, the electrification amount of toner cannot follow the environmental variation. Likewise, the electrification amount of toner during the second stopping period T2 is increased only from "20" to "25," and thus, the electrification amount of toner cannot follow the environmental variation. Accordingly, the developing property of the developer is not stabilized with respect to the environmental humidity immediately after each stopping period T1 or T2.

When the conventional setup is performed, the setup is immediately after each stopping period T1 or T2 is performed under the electrification amount of toner deviation from a stable state, and the electrification amount of toner greatly varies depending on, for example, the progress of a subsequent job.

Meanwhile, in the present exemplary embodiment, the developer refresh mode is performed by the setup immediately after each stopping period T1 or T2 so that the electrification amount of toner rapidly becomes the electrification amount of toner that is stabilized with respect to an environment.

Figure 7:
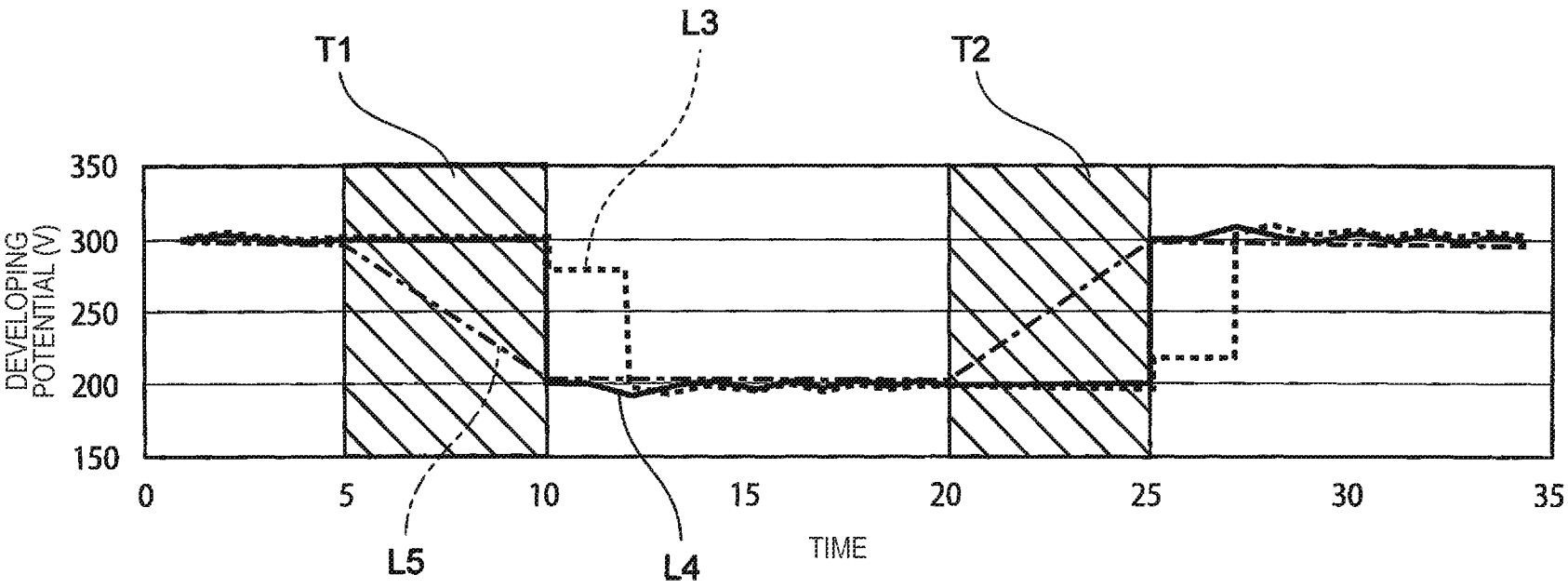
FIG. 7 is a graph illustrating a variation in developing potential as one example of a forming condition.

FIG. 7 is a graph illustrating a variation in developing potential as one example of the forming condition.

In the graph of FIG. 7, the horizontal axis represents time and the vertical axis represents developing potential. In addition, a dotted line L3 in the graph represents a variation in developing potential when the conventional setup is performed, a solid line L4 in the graph represents a variation in developing potential in the present exemplary embodiment, and a chain line L5 in the graph represents a variation in developing potential, which is estimated from the environmental humidity based on the relational expression.

In a case where the conventional setup is performed, with the setup immediately after the first stopping period T1, the developing potential is changed from 300V before the first stopping period T1 to 280V to correspond to the variation in electrification amount of toner during the first stopping period T1 illustrated in FIG. 6. Then, even if the electrification amount of toner varies as illustrated in FIG. 6, the developing potential of 280V is maintained until the next setup is performed, and with the setup performed before a subsequent job, the developing potential becomes 220V. In addition, with the setup performed immediately after the second stopping period T2, the developing potential is changed from 200V to 220V by, and even if the electrification amount of toner varies as illustrated in FIG. 6, the developing potential of 220V is maintained until the next setup is performed. Then, as the setup is performed before a job, the developing potential becomes 330V.

Meanwhile, in the present exemplary embodiment, with the setup performed immediately after the first stopping period T1, the developing potential Vdeve1 of 280V is calculated as the first condition in the same manner as the related art, and the developing potential Vdeve2 of 200V is calculated as the second condition as illustrated by the chain line L5. In addition, as a difference between the first condition and the second condition, |Vdeve1−Vdeve2|=|280−200|=80V is calculated. Here, assuming that a predesigned threshold is set as, for example, 20V, the developer refresh mode is performed because the difference between the first condition and the second condition (=80V) is larger than the threshold (=20V). As illustrated in FIG. 5, because the humidity varies from a low humidity of 10% to a high humidity of 90% during the first stopping period T1 an operation of ejecting the toner, which reduces the electrification amount of toner, is performed as the developer refresh mode. As a result, as illustrated in FIG. 6, the electrification amount of toner rapidly becomes the electrification amount of toner of "20," which is stabilized with respect to the environmental humidity. Then, as the third condition is calculated by repeated setup under the condition of the stabilized electrification amount of toner, the developing potential of 200V may be obtained, and a charging voltage, the developing bias, and the exposure potential of the third condition including the developing potential are set to each element of the printer 1.

In addition, in the present exemplary embodiment, with the setup performed immediately after the second stopping period T2, the second condition Vdeve2 becomes 300V while the first condition Vdeve1 is 220V. Thus, because the difference between the first condition and the second condition (=80) is larger than the threshold (=20), the developer refresh mode is performed. As illustrated in FIG. 5, because the humidity varies from the high humidity of 90% to the low humidity of 10% during the second stopping period T2, an agitating operation of the developer to increase the electrification amount of toner is performed as the developer refresh mode. As a result, as illustrated in FIG. 6, the electrification amount of toner becomes the electrification amount of toner of "40," which is stabilized with respect to the environmental humidity. Then, as the third condition is calculated by repeated setup under the stabilized electrification amount of toner, the developing potential of 300V may be obtained, and the charging voltage, the developing bias, and the exposure potential of the third condition including the developing potential are set to each element of the printer 1.

Figure 8:
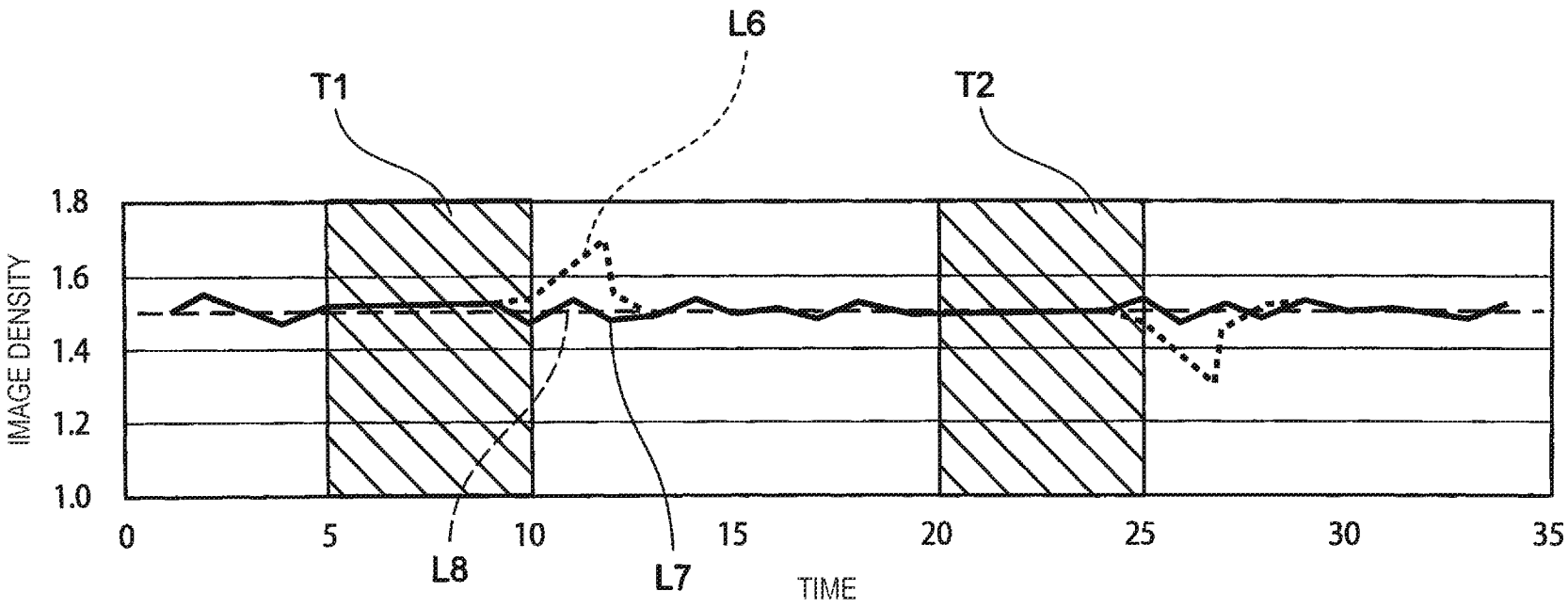
FIG. 8 is a graph illustrating a variation in image density.

FIG. 8 is a graph illustrating a variation in image density.

In the graph of FIG. 8, the horizontal axis represents time and the vertical axis represents image density. In addition, a thick dotted line L6 in the graph represents a variation in image density when conventional setup is performed, a solid line L7 in the graph represents a variation in image density in the present exemplary embodiment, and a thin dotted line L8 in the graph represents a target density.

When the conventional setup is performed, the electrification amount of toner (and the developing property) varies as illustrated in FIG. 6 after the forming condition is determined with the setup performed immediately after each stopping period T1 or T2. Thus, the image density deviates from the target density as illustrated by the thick dotted line L6 in FIG. 8.

On the other hand, in the present exemplary embodiment, even if a rapid variation in humidity occurs as illustrated in FIG. 5, the image density is always maintained close to the target density as represented by the solid line L7 of FIG. 8. That is, in the present exemplary embodiment, because a delay of control, which occurs in the conventional setup, does not occur, the density remains close to the target.

In addition, while an example of determining whether the difference between the first condition and the second condition is large via simple comparison with a specific threshold is illustrated in the foregoing description, the determination as to "the exceeding of a predetermined degree" in the present invention may be determined via comparison with a threshold, which varies depending on the developing potential, the environmental temperature/humidity, or the like.

In addition, while a color printer is illustrated as an exemplary embodiment of the image forming apparatus of the present invention in the present exemplary embodiment, the image forming apparatus of the present invention may be applied to a copying machine, a facsimile machine, or a composite machine, and may also be applied to a dedicated monochrome machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member that holds an image formed on a surface of the image holding member;

a latent image forming device that forms an electrostatic latent image on the image holding member;

a developing device that contains a developer therein and develops the electrostatic latent image with the developer;

an image density detector that detects a density of the image formed by the developing device;

a first condition section that derives, based on a difference between the density of the image detected by the image density detector and a predetermined target density, a first forming condition in forming an image by an image forming section including the latent image forming device and the developing device;

an environmental detector that detects an environmental state of the image forming section;

a second condition section that derives, from the environmental state detected by the environmental detector, a second forming condition that is previously made to correspond to an environmental state of the image forming section, wherein the density of the formed image becomes the target density;

a stabilization section that causes, when a difference between the first and second forming conditions acquired by the first condition section and the second condition section exceeds a threshold value, the image forming section to perform a stabilization operation in which a developing property of the developer in the developing device is stabilized with respect to a current environmental state, and thereafter cause the formation of the image by the image forming section, the density detection by the image density detector and the derivation by the first condition section, by which a third forming condition is derived, to be performed again; and at least one hardware processor configured to implement the first condition section, the second condition section, and the stabilization section, wherein the at least one hardware process calculates the difference between the forming conditions.

2. The image forming apparatus according to claim 1, wherein the environmental detector detects an environmental humidity of the image forming section, the stabilization section agitates, when the environmental humidity is low, the developer within the developing device, as the stabilization operation, and the developing device comprises a transport member that transports the developer while agitating the developer, and the developer is agitated by the transport member.

3. The image forming apparatus according to claim 1, wherein the environmental detector detects an environmental humidity of the image forming section, the developer comprises a color material for forming an image, the developing device is provided with a supply device to supply the color material, and the stabilization section causes, when the environmental humidity is high, the color material contained in the developer within the developing device to be consumed so as to cause the supply device to supply a new color material to the developing device, as the stabilization operation.

4. The image forming apparatus according to claim 2, wherein the environmental detector detects the environmental humidity of the image forming section, the developer comprises a color material for forming an image, the developing device is provided with a supply device to supply the color material, and the stabilization section causes, when the environmental humidity is high, the color material contained in the developer within the developing device to be consumed so as to cause the supply device to supply a new color material to the developing device, as the stabilization operation.

* * * * *